United States Patent [19]

White

[11] 4,277,065

[45] Jul. 7, 1981

[54] GOLF GAME AND METHOD FOR PLAYING THE SAME

[76] Inventor: William D. White, 8680 Emard Ter., Sidney, British Columbia, Canada, V8L 1K4

[21] Appl. No.: 941,967

[22] Filed: Sep. 13, 1978

[51] Int. Cl.[3] ..... A63F 3/00

[52] U.S. Cl. ..... 273/245; 273/282

[58] Field of Search ..... 273/245

[56] References Cited

U.S. PATENT DOCUMENTS

| | | | |
|---|---|---|---|
| D. 107,160 | 11/1937 | Schuster | 273/245 |
| 1,615,982 | 2/1927 | Jewett | 273/245 |
| 1,781,230 | 11/1930 | Hill | 273/245 |
| 3,260,526 | 7/1966 | Seitz | 273/245 |
| 3,820,786 | 6/1974 | Candor | 273/245 |
| 3,826,498 | 7/1974 | Monek | 273/245 |
| 4,113,260 | 9/1978 | Sain | 273/245 |

*Primary Examiner*—Richard C. Pinkham
*Assistant Examiner*—Carl Moy
*Attorney, Agent, or Firm*—Phillips, Moore, Weissenberger, Lempio & Majestic

[57] ABSTRACT

A golf game comprises a board having at least one golf hole defined thereon, including a tee and a green. A coordinate system is defined on the board and includes a plurality of first lines extending from the tee to the green and a plurality of second lines disposed transversely relative to the first lines to intersect therewith. When the game is played, a player initially places a flag stick at a selected location on the green and thereafter sequentially rolls dice to determine the direction and distance his marker (ball) will be moved from the tee towards the green to simulate the flight and location of a golf ball on the board. Once the player's marker has reached the green, he then proceeds to roll further dice in his attempt to place the marker at the "hole" whereat the flag stick has been placed. Various obstacles and hazards are defined on the board to further test the player's ingenuity in playing the game.

16 Claims, 4 Drawing Figures

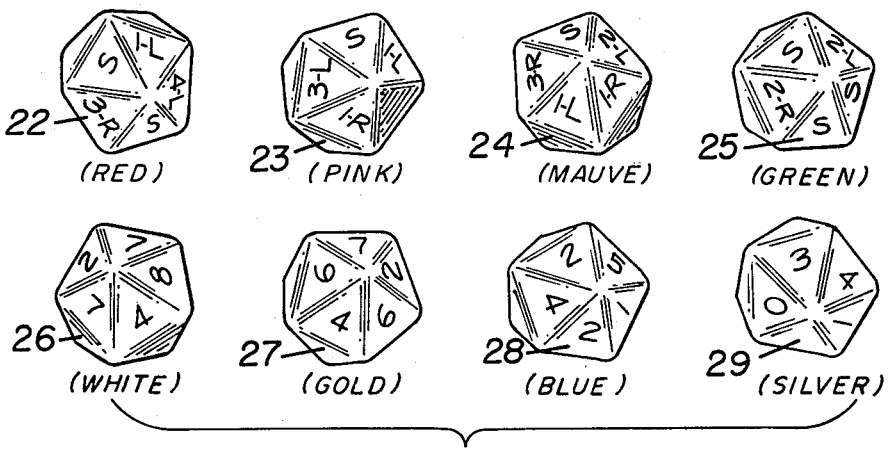
FIGURE 2.
FIGURE 3.
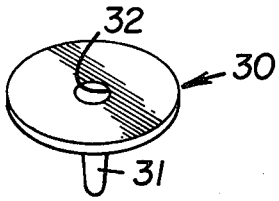
CLUBHOUSE GOLF
| HOLD NUMBERS | PAR | YARDAGE | RED | GREEN | BLUE | ORANGE | WON + LOST − 1/2 0 | HDCP STROKES |
|---|---|---|---|---|---|---|---|---|
| 1 | 4 | 425 | 3-1 | 5+1 | 6+2 | 4+0 | | |
| 2 | 4 | 370 | 4-1 | 3+0 | 5+3 | 4+0 | | |
| 3 | 4 | 350 | 3-2 | 6+2 | 5+4 | 3-1 | | |
| 4 | 3 | 228 | 3-2 | 4+3 | 4+5 | 3-1 | | |
FIGURE 4.

GOLF GAME AND METHOD FOR PLAYING THE SAME

BACKGROUND OF THE INVENTION

The popularity of golf has given rise to the need for a game which can be played indoors, but yet simulates the intricacies and actual playing conditions of a golf game played outdoors. In particular, the board game as played indoors should take into account club selection and the various other considerations which must be thought out prior to making a "shot". To date, conventional board games have not satisfied this need.

SUMMARY OF THE INVENTION

The golf game embodying this invention, adapted to be played indoors, simulates the playing of an actual game of golf outdoors and requires the same decision-making process, including club selection and the like.

The golf game comprises a board defining at least one golf hole thereon, including a tee and a green spaced at a predetermined distance from the tee to simulate the fairway and yardage therebetween. A coordinate system is defined on the board to comprise a plurality of first lines extending from the tee to the green and a plurality of second lines disposed transversely relative to and intersecting the first lines whereby the point of intersection of each pair of first and second lines is adapted to simulate the location of a golf ball on the board. A marker means, simulating the golf ball, is positionable on the coordinate system at one of the points of intersection of the first and second lines. Means controlled by a player, such as a plurality of dice, randomly display information thereon to at least simulate the distance and direction the marker means should be moved on the coordinate system from the tee to the green. In the preferred embodiment of the invention, once a player's marker means has been positioned on the green, at least one additional die is rolled in the player's attempt to locate his marker means at a flag stick positioned on the green, prior to commencing play. Once the marker means has been positioned at the flag stick, he is deemed to have "holed-out" and to thus have played the hole in the determined number of strokes.

BRIEF DESCRIPTION OF THE DRAWINGS

Other objects of this invention will become apparent from the following description and accompanying drawings wherein:

FIG. 2 illustrates dice employed in playing of the game;

FIG. 3 illustrates a player's marker utilized in playing the game and adapted to be positioned at various locations on the board; and FIG. 4 partially illustrates a score card employed to record the scores of the players.

DETAILED DESCRIPTION

Figure 1:
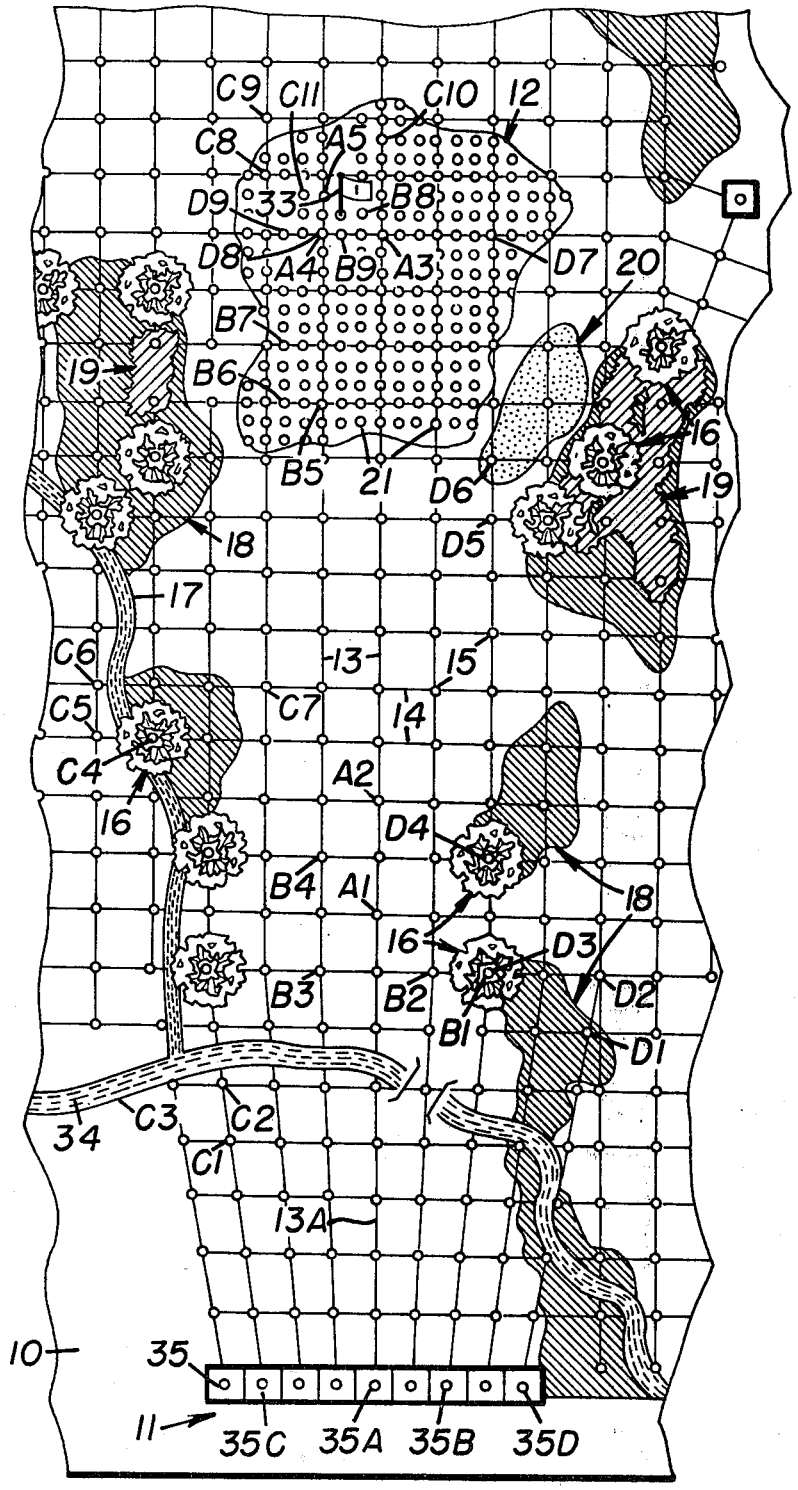
FIG. 1 partially illustrates a board included in the golf game of this invention, the board defining a golf hole thereon.

FIG. 1 partially illustrates a flat board 10 having a golf hole suitably defined thereon by a standard printing process. The golf hole comprises a tee 11 and a green 12 spaced at a predetermined distance from the tee to define a fairway therebetween and to simulate the yardage on an actual golf course. A coordinate system is defined on the board and comprises a plurality of first lines 13 extending from the tee to the green and a plurality of second lines 14 disposed transversely relative to and, for the most part, intersecting the first lines.

A small hole 15 is suitably formed in the board at the point of intersection of each pair of first and second lines with each hole adapted to simulate the location of a golf ball or marker on the board, as hereinafter more fully described. The board may further have various obstacles and hazards suitably defined thereon and color-coded to depict, for example, trees 16, a water hazard 17, rough 18, bushes 19 and bunkers or sand traps 20. It should be further noted that green 12 has a sub-coordinate system or additional holes 21 within its boundaries, formed in the board between and on lines 13 and 14 for purposes hereinafter described.

Referring to FIG. 2, eight dice 22–29 are employed with the game to provide means controlled by a player for randomly displaying information for purposes of playing the game. FIG. 3 illustrates a marker means 30 which is positionable within holes 15 and 21 formed in the board in response to the players rolling of one or more of dice 22–29. The T-shaped marker means comprises a pin 31 adapted to be inserted into one of the holes during playing of the game and a hole 32 formed thereon to receive the pin of another player's marker means should two markers be positioned at the same hole during the course of playing the game. It should be further noted in FIG. 1 that a pin 33, simulating a flag stick, is adapted to be selectively positioned in one of the holes 21 formed on green 12 prior to commencement of the game.

The so-called "directional dice" 22–25 and "distance dice" 26–29 each preferably has 14 sides to indicate various directions and distances, as shown on the following chart:

CHART NO. I

| DIRECTIONAL DICE | | | | DISTANCE DICE | | | |
|---|---|---|---|---|---|---|---|
| Die | No. Sides | Code | Yard./Dir. | Die | No. Sides | Code | Yard. |
| 22 | 6 | S | STRAIGHT | 26 | 1 | 9 | 225 |
| (RED) | 1 | 1-L | 25/LEFT | (WHITE) | 3 | 8 | 200 |
| | 1 | 2-L | 50/LEFT | | 3 | 7 | 175 |
| | 1 | 3-L | 75/LEFT | | 2 | 6 | 150 |
| | 1 | 4-L | 100/LEFT | | 2 | 5 | 125 |
| | 1 | 1-R | 25/RIGHT | | 1 | 4 | 100 |
| | 1 | 2-R | 50/RIGHT | | 1 | 3 | 75 |
| | 1 | 3-R | 75/RIGHT | | 1 | 2 | 50 |
| | 1 | 4-R | 100/RIGHT | | | | |
| 23 | 2 | S | STRAIGHT | 27 | 1 | 8 | 200 |
| (PINK) | 2 | 1-L | 25/LEFT | (GOLD) | 1 | 7 | 175 |
| | 3 | 2-L | 50/LEFT | | 3 | 6 | 150 |
| | 3 | 3-L | 75/LEFT | | 3 | 5 | 125 |
| | 2 | 4-L | 100/LEFT | | 3 | 4 | 100 |

CHART NO. I-continued

| DIRECTIONAL DICE | | | | DISTANCE DICE | | | |
|---|---|---|---|---|---|---|---|
| Die | No. Sides | Code | Yard./Dir. | Die | No. Sides | Code | Yard. |
| | 1 | 1-R | 25/RIGHT | | 1 | 3 | 75 |
| | 1 | 2-R | 50/RIGHT | | 1 | 2 | 50 |
| | | | | | 1 | 1 | 25 |
| 24 | 2 | S | STRAIGHT | 28 | 1 | 6 | 150 |
| (MAUVE) | 2 | 1-R | 25/RIGHT | (BLUE) | 1 | 5 | 125 |
| | 3 | 2-R | 50/RIGHT | | 2 | 4 | 100 |
| | 3 | 3-R | 75/RIGHT | | 3 | 3 | 75 |
| | 2 | 4-R | 100/RIGHT | | 3 | 2 | 50 |
| | 1 | 1-L | 25/LEFT | | 3 | 1 | 25 |
| | 1 | 2-L | 50/LEFT | | 1 | 0 | 0 |
| 25 | 7 | S | STRAIGHT | 29 | 1 | 4 | 100 |
| (GREEN) | 2 | 1-L | (PUTT) | (SILVER) | 2 | 3 | 75 |
| | 2 | 2-L | (PUTT) | | 4 | 2 | 50 |
| | 2 | 1-R | (PUTT) | | 4 | 1 | 25 |
| | 1 | 2-R | (PUTT) | | 3 | 0 | 0 |

As noted on the chart, dice 22–29 may be colored red, pink, mauve, green, white, gold, blue and silver, respectively, to facilitate use thereof. In addition, four markers 30 (one shown) may be color-coded red, green, blue and orange to facilitate playing of the game with up to four players, i.e., a foursome. FIG. 4 partially illustrates a scorecard which may be utilized with the game for purposes of medal or match play scorekeeping.

As discussed above, the golf game embodying this invention simulates the playing of an actual round of golf in minature and demands the same shot-making decisions, challenges and intricacies. For example, judgment must be carefully exercised in correctly selecting the best dice from dice 22–29 for a particular shot, based on the "lie" of marker (ball) 30. As shown in FIG. 1, each golf hole (total of 18) is laid-out in a professional manner with par for the 18-hole course being a somewhat standard 72, for example. As is typical with a standard golf course, the 18 holes may constitute four par threes, four par fives and ten par fours.

The various obstacles and hazards suitably printed on board 10 may also be color-coded, along with tee 11 and green 12, to simulate like conditions on an actual golf course. For example, trees 16 may be colored dark green, water hazards 17 colored blue, rough areas 18 colored an olive green, bushes 19 colored brown, and bunkers or sand traps 20 colored tan. In addition, one or more ditches 34 may be defined on the board to supplement the other obstacles and hazards. Green 12 may be colored light green, whereas lines 13 and 14 may be suitably colored differently to clearly depict the coordinate or grid system on the board. It should be noted that major portions of the lines are linear and that the lines may deviate in places to accommodate dimensional perimeters of the golf hole, e.g., the portions of lines 13 between tee 11 and ditch 34 coverge towards the tee which is narrower than the remaining portion of the golf hole.

It should be particularly noted that the coordinate system comprising lines 13 and 14 generally resembles the lines of latitude and longitude on a map and, in a like manner, function to locate a particular marker 30 at a particular location on the course. The lines will thus establish direction and distance a marker 30 will be moved from tee 11 to green 12 during playing of the game. As will be more fully understood hereinafter, a player is free to use whichever orientation he chooses, along a line 13 or line 14, which may prove to his advantage for a particular shot. Although line 13 may be generally considered to constitute "distance lines", the player may encounter a situation wherein he chooses to elect a particular transverse line 14 as a "distance line", e.g., when his marker is positioned on a side of green 12 and his next shot requires a pitch shot for placing his marker on the green.

PLAYING THE GAME (GENERAL)

The object of the game is to "hole-out" a player's marker 30 from tee 11 to green 12 in as few "strokes" as possible. The order of play may be determined by the flip of a coin, for example, and has no particular significance in a player's score. The eighteen flag sticks 33 (one shown) may be placed on the putting greens by the players, in turn, with each flag being placed anywhere on a respective green, but no closer than three marker holes from the edge of the green.

A first player to tee-off places his marker in a chosen hole 35 in tee 11 which depicts the beginning of a particular line 13. The player may place his marker in any one of the holes 35 (usually hole 35A), taking into consideration the placement of flag stick 33 on green 12. The player will then ordinarily pick up red die 22 which he will eventually throw to determine whether his marker 30 will follow that selected line or not. However, prior to throwing the red die, the player must preselect his "club", usually simulated by two dice, which will be used to determine the flight and roll of the marker or simulated ball. The player cannot roll the red die until he has made this complete selection.

If a deviation is indicated, the marker must be moved sideways the indicated amount; par three holes being the exception as described hereinafter. The flight die is then thrown (usually white die 26) and the marker advanced along holes or points 15 in accordance with the code exposed to the player on the die, e.g., as shown in Chart No. I, code "9" would represent movement of the marker nine holes 15 along a particular line 13 or a simulated 225 yards. The roll die is then thrown and the marker is further advanced to indicate the roll and additional distance which the marker has attained, e.g., an exposed code "4" on blue die 27 would allow the player to further advance his marker four holes 15 (100 yards) on the particular line 13 to provide an overall drive of thirteen positions or 325 yards on the board, assuming that no obstacle or hazard was encountered. These three throws would constitute one stroke for scorekeeping purposes.

The remaining players, if any, then tee-off in the preselected order. Should a subsequent player's marker be positioned on the same hole 15 which accommodates a prior player's marker, hole 32 (FIG. 3) in the first marker may be utilized to receive pin 31 of the second marker. When all of the players have taken their first stroke, they will then take their second stroke in the same order as previously determined to facilitate score-keeping. As will be more fully understood from the examples hereinafter set forth, judgment must be exercised in the shot-making process by selecting the appropriate directional die (die 22, 23 or 24) and the appropriate combination of distance dice (26–29) which will favor movement of player's marker 30 towards and onto green 12 for subsequent "putting". The execution of any particular shot from the fairway may utilize any desired combination of distance dice 26–29 with the proviso that the selection of the dice must be decided upon and the order specified before the shot is "hit". This selection simulates the choosing of an appropriate golf club during the playing of an actual game of golf.

RULES OF THE GAME

As indicated above, when a player places his marker 30 in a particular hole 35 of tee 11 to commence play, he must move his marker sideways the amount indicated upon rolling of red die 22. This sideways deviation, if any, may be delayed on par three holes for reasons hereinafter set forth. However, on par four (FIG. 1) and par five holes, if the directional die indicates deviation of the marker sideways beyond the row of tee marker holes 35, the marker is deemed to be out of bounds with a resulting loss of stroke and distance, unless the next shot can be executed from a "wrong" fairway. Upon incurring the penalty of stroke and distance for being out of bounds, the player is free to place his marker in any selected tee marker hole 35 with the player now lying "2" strokes.

If a marker should encounter a tree, it is deemed to temporarily stop whereby the red directional die 22 must be thrown again to determine whether the marker has cleared the tree as depicted by "S" on the die (see above Chart No. I) or whether the marker has been deflected by the tree and, if so, by how much and in what lateral direction. Each lateral hole is then counted for distance. A tree may never deflect the marker further than the "energy" remaining in the flight or roll of the marker.

When marker 30 is positioned on the fairway between tee 11 and green 12, the marker will advance along a particular directional line 13 to the amount of the additive flight and roll distances indicated by the selected dice, unless the directional die indicates a deviation from that line. The deviation, if any, may be taken after the marker has landed, and before it has rolled, at the player's discretion, i.e., it may be to the player's advantage to do so as in the example hereinafter set forth for player "B".

The marker is deemed to have rolled across a bridge 36 if sufficient distance is indicated along a particular directional line 13. Should the marker roll into ditch 34, it is deemed to have stopped and must be "dropped" on the tee side of the ditch without penalty (player "C" in an example hereinafter set forth). If the marker stops under a tree 16, a "steeper club" (die 28 or 29) must be selected for the flight phase of the next shot, but any combination of roll dice may be selected.

When the marker is on the fairway and near green 12, the flight selection may be eliminated at the player's discretion and a "run-up" shot may be played during which the marker is deemed to be on the ground. Each individual marker hole 15 and 21 is then used to measure distance rather than the point of each intersection of a respective pair of lines 13 and 14.

A marker in flight from the fairway may be deemed to clear an obstacle, except a tree 16, providing that it lands beyond the obstacle. When flight or roll extends beyond the end of any directional line 13 or any transverse line 14, the marker is deemed to have been hit out of bounds and the player's next turn consists of moving his marker to the closest point on the fairway whereby he must incur a penalty stroke. When the marker fails to clear a bunker 20, the ball is deemed to have stopped therein and he must then abide by the following rules.

When the marker rests in a bunker 20, it must be put in flight along its presently occupied directional line 13, or as indicated by the throw of the selected directional die. The marker may not be rolled out of the bunker and the distance the marker travels will be measured along the intersectional holes and not from one marker hole 21 to another marker hole 21, as would a marker on the fairway.

If a marker rolls into a bunker, the amount of roll is measured in the ratio of one marker hole to every three indicated by the roll die, once the bunker is entered. Otherwise stated, the roll is retarded on a ratio of three to one in rolling through the bunker. Some bunkers may have a higher ratio than this and, if so, the ratio will be indicated on the particular bunker.

The rules for landing on water hazard 17 are as follows. When the marker is deemed to have landed or rolled into the water hazard, the marker is dropped out beside the hazard and positioned in the nearest marker hole 15 on the fairway (closest point of relief), no closer to putting green 12. The player is then penalized one stroke. The marker is deemed to fly across a water hazard if a particular die 26–29 so indicates.

When the marker lands in rough 18, its roll beyond that point is retarded by a factor of two. A stroke from the rough must be taken with a shorter distance club, i.e., die 28 or die 29. A normal roll may be taken thereafter by throwing die 26, 27, 28 or 29, as appropriate. A ball landing in a bush 19 is deemed to have no roll and is dropped out to an adjacent hole 15, no closer to green 12 with a one stroke penalty ("unplayable lie").

When a particular player's marker 30 lands on green 12, the player may attempt to "bounce" the marker right or left, if advantageous, by throwing the appropriate directional die. The directional die can only be thrown after having applied the directional correction, if any, of the previously thrown directional die. After the bounce, the indicated roll is taken as displayed by the exposed code on the particular die.

When the marker comes to rest on green 12, the subsequent putt will consist of selecting the putting directional die 25 and then selecting any combination of distance dice 22–24 and thrown as many times as decided upon prior to player's commencing of his "putting" stroke. The putt must then be carried out in harmony with that specified selection of dice.

It should be noted that the direction of the putt is not necessarily along the grid lines 13 and 14, but must be with respect to the row of marker holes 21 most closely running between the marker and flag stick 33, in the direction of the greatest number of holes. For example, an indication on die 25 of "2-R" (see Chart No. I), would tell the player to take the putt along a row of marker holes which lies two rows of holes to the right of flag, as viewed from the point at which the putt originated.

If die 25 indicates "S", the putt is deemed to follow the row of marker holes leading most directly to the flag. Then, the selected putting distance die or dice may leave the marker short of the flag stick's hole, take the marker beyond the flag stick or precisely drop it into the hole or cup, whichever may be indicated. The putt is deemed to be "holed-out" when the marker and the flag stick coincide. Thus, it is sometimes possible to sink a long putt or "hole the marker out" from the fairway. When the marker has come to a stop within two holes (21) in any direction from the flag stick (33), only the directional die (25) is used for the next shot. If the die indicates that the putt has deviated to the right or to the left of the cup, the next putt is deemed to have dropped into the cup and is scored accordingly.

MISCELLANEOUS RULES AND DESCRIPTION

Once club selection is made in the afore-described manner, prior to the taking of a particular shot, no later changes can be made in the execution of the shot. If the flight proves to be longer than desired, for example, the player cannot then exchange his roll die for one that may give him a shorter roll and vice-versa. In order for the game to be realistically proportioned, die 26 (white) may only be used for flight in conjunction with die 28 (blue) or 29 (silver), both indicating roll.

Flight die 27 (gold) is ordinarily used only with roll die 28 (blue) or die 29 (silver), but may be used for both "flight" and "roll" once the marker is positioned within one hundred yards (four marker holes 15) from green 12.

On par three holes (not shown) it is, of course, possible to reach the putting green with the first shot from the tee. Therefore, if a deviation from the desired line of flight is indicated by the first throw of directional die 22, at the time of teeing-off, deviation may be deferred until the marker is on the putting green. This rule is deemed necessary since such deviation may be taken sideways along marker holes that are much closer together on the green and, therefore, the deviation will be much less. This latter rule applies to par three holes only when on the tee and may be invoked only when the marker comes to rest on the putting green after the tee shot and not in order to avoid an obstacle.

As stated above, if the marker comes to rest at the side of green 12, it may prove advantageous to use transverse lines 14 for determining direction and line 13 for determining distance. Thus, under these circumstances, there may be more than one way to execute a directional change in the shot to further tax the player's ingenuity in this respect. The player himself has the prerogative of choosing the orientation upon which he moves his marker and, thus, solely determines where his marker should be placed. This is the one instance (orientation) in which the player may change his mind after the dice have been thrown.

As indicated above, a particular directional die 22, 23 or 24 must be first thrown, the selection depending on the particular location of a player's marker on the board. Die 25 is the only one which is utilized for putting purposes on green 12.

It should be understood that obstacles and hazards 16–20 are not considered when a marker is moved sideways along a transverse line 14. It should be again noted that not all directional lines 13 are intersected by a transverse line 14. In a situation where only a broken transverse line 14 exists between directional lines 13, any sideways move by a player must result in his marker being dropped back one marker hole 15.

As further indicated above, the ball marker must always be appropriately moved after the flight die is thrown. Any indicated directional change must be made, at the latest, before the roll die is thrown. Should a marker stop on the wrong green, the marker may be dropped onto the nearest fairway and no closer to the intended green, with no penalty.

When measuring distance of flight, the marker holes 15 located at the intersection of each pair of intersecting lines 13 and 14 is used. When measuring roll, all marker holes along the designated line are used, including the closely-spaced holes 21 on green 12.

The flight phase of a chip shot is measured by marker holes 15 and not along closely-spaced holes 21, even though flight may be over a portion of the putting green. The roll subsequent to a chip shot, however, is measured along all marker holes, including holes 15 and 21. A run-up shot from the fringe of green 12 has no flight phase and its roll is determined along all marker holes 15 and 21.

In summary, when a shot is made to depict marker 30 in flight, its distance is measured by the marker holes 15 and when the marker is deemed to be rolling on the ground, its distance is measured by all marker holes along its chosen path, including holes 21. If a player finds that a particular shot becomes unduly complicated and unplayable, he is permitted to place his marker on the fairway, no nearer flag stick 33, and must incur one penalty stroke in place of his next turn. As further suggested above, the golf game embodying this invention can be by match or medal play, whichever is desired by the players.

In order to aid the players in their club selection during playing of the game, the following chart may be utilized to approximately indicate the particular die (golf club) which should be used for a particular shot.

CHART NO. II

GOLF CLUB SELECTION GUIDE
(Dice 26–29)

| Desired Shot/Yardage | Club Selection | Flight Die Distribution Code | Roll Die Distribution Code |
|---|---|---|---|
| Maximum From Tee | No. 1 Wood or Driver | Die 26 (white) 150–200 yards 6–8 | Die 28 (blue) 25–75 yards 1–3 |
| Maximum On Fairway | No. 3 Wood | Die 26 (white) 150–200 yards 6–8 | Die 28 (blue) 25–75 yards 1–3 |
| Maximum Flight/ Minimum Roll | No. 4 Wood or No. 2 Iron | Die 26 (white) 150–200 yards 6–8 | Die 29 (silver) 0–50 yards 0–2 |
| Medium Flight/ Medium Roll | No. 3 Iron | Die 27 (gold) 150–200 yards 4–6 | Die 28 (blue) 25–75 yards 1–3 |
| Maximum Roll | | May be used, if within 150 yards of putting green (die 26 [white] and 27 [gold]). | |
| Medium Flight/ Minimum Roll | No. 4 Iron | Die 27 (gold) 100–150 yards 4–6 | Die 29 (silver) 0–50 yards 0–2 |
| Semi-Medium Flight/ Maximum Roll | No. 5 Iron | Die 28 (blue) 25–75 yards 1–3 | Die 26 (white) 150–200 yards 6–8 |
| Semi-Medium Flight/ Medium Roll | No. 6 Iron | Die 28 (blue) 25–75 yards 1–3 | Die 27 (gold) 0–50 yards 4–6 |
| Semi-Medium Flight and Roll | No. 7 Iron | Die 28 (blue) 25–75 yards 1–3 | Die 28 (blue) 25–75 yards 1–3 |
| Semi-Medium Flight/ | No. 8 Iron | Die 28 (blue) 25–75 yards | Die 29 (silver) 0–2 yards |

CHART NO. II-continued

GOLF CLUB SELECTION GUIDE
(Dice 26–29)

| Desired Shot/Yardage | Club Selection | Flight Die Distribution Code | Roll Die Distribution Code |
|---|---|---|---|
| Minimum Roll | | 1–3 | 0–2 |
| Minimum Flight/ Maximum Roll | No. 9 Iron | Die 29 (silver) | Die 26 (white) or 27 (gold) |
| | | 0–2 | 6–8 4–6 |
| Minimum Flight/ Minimum Roll | Sandwedge | Die 29 (silver) 0–50 yards | Die 28 (blue) or 29 (silver) |
| | | 0–2 | 1–3 0–2 |
| Putt | Putter | Any combination of distance dice, thrown as many times as desired, before putting. | |
| Run-Up | | Shot near green which has only roll . . . any desired die can be used. | |

EXAMPLE OF PLAYING THE GAME

Assuming four players "A", "B", "C" and "D" intend to play the game, they may flip a coin or otherwise suitably select the order of play. Such order may also be utilized to sequentially place a flag stick 33 on each of the eighteen greens of the game. The following example will carry the game through only the playing of the hole illustrated in FIG. 1. Although the game will normally be played by alternating the four player's shots or by permitting the player furthest from flag stick 33 to make the next ensuing shot, the following examples contemplate a single player holing-out from tee to green without interruption for sake of clarity.

FIRST PLAYER "A" (RED)

After flag stick 33 has been suitably inserted into an appropriate hole 21 on green 12, the first player would normally select dice 22 (red), 26 (white) and 28 (blue). Since the hole has a yardage of 420 yards (FIG. 4), the latter two selections of dice 26 and 28 would be in order. The player would normally position his marker in centered hole 35A on the tee, since this initial position of his marker will provide the greatest margin of error upon subsequent roll of directional die 22 (red).

The player then rolls directional die 22. Assuming that "S" is rolled, the player will know that his first shot will proceed linearly along line 13A and towards green 12. The player then rolls distance die 26 (white) to indicate the flight of the ball. Assuming that the die turns up code "8", the player will move his marker to point A1 along line 13A. Assuming that rolling of die 28 (blue) turns up code "2", indicating the roll of the ball, the player will further move his marker to point A2. This completes the first player's first shot or drive.

Assuming that the first player again selects directional die 22 (red) and distance dice 26 (white) and 28 (blue) for his second shot, he may then proceed to roll directional die 22. Assuming that such die reflects code "S", the second shot from the fairway is deemed to proceed straight along line 13A. Further assuming that rolling of die 26 to indicate that the marker has hit the green at point A3, a rolling of die 23 (pink) to indicate code "3-L" will result in his marker being moved to point A4. A rolling of roll die 28 (blue) to indicate code "2" will move the marker to point A5 on the green to complete his second shot. As above-described with respect to a player's election to play a "controlled bounce" on the green upon the landing of his ball at point A3 thereon, die 23 (pink) was considered as being selected for this purpose.

First player A is now within two marks or holes 21 of flag stick 33 and thus needs only to roll die 25 (green). Assuming that upon rolling of the die it turns up code "S", the putt is deemed straight and the player is thus deemed to hole-out for a birdie three on the hole. As shown on the scorecard in FIG. 3, player A thus records a 3—1 reflecting a birdie three on the hole and thus, one under par (four). In summary, the player's first shot comes to rest at point A2, his second shot at point A5 and his third shot or putt is deemed to have been sunk.

SECOND PLAYER "B" (GREEN)

Assuming that second player B has initially placed his marker in tee hole 35A and rolls die 22 (red) to reflect code "2-R", he must move his marker to tee hole 35B. Further assuming that the second player then sequentially rolls dice 26 (white) and 28 (blue) to reflect codes "8" and "4", respectively, it should be noted that a tree 16 is encountered at point B1, necessitating a further rolling of directional die 22 to determine whether or not the flight of the ball clears the tree. Assuming that the rolling of die 22 (red) indicates code "3-L", the ball lands at point B2 and the player's marker is moved to this point to indicate a deflection of the ball from the tree only one hole 15.

Die 28 (blue) is then rolled and is deemed to indicate code "4". Since there are two deflection holes remaining, as indicated by the previous roll of die 22 (red), the marker is moved sideways to point B3 and forward two more holes to point B4 as a result of hitting tree 16, with some loss of distance and direction.

Player B is now ready to "hit" his second shot. Subsequent rolling of dice 22 (red), 26 (white) and 28 (blue) to indicate codes "2-L", "7" and "4", respectively, will permit the player to move his marker sequentially to positions B5, B6 and B7. As mentioned above, there are two ways to count this second shot when green 12 can be reached on the flight of the ball. The "2-L" deviation may be taken along the horizontal line 14 at point B4, or it may be deferred until the ball lands on the green at point B5.

Player B, at point B7 on the green, is now putting and positioned eight marker holes 21 away from flag stick 33. Assuming that the player rolls die 25 (green) to indicate "1-R" and rolls die 26 (white) to indicate code "8", B's marker would be placed along one row of holes 21 to the right of the flag, and advanced eight rows of holes forward to point B8 or one hole to the right of the flag to complete his third shot. For his next putt, the player thus needs only to roll die 25 (green) and assuming that it turns up code "1-L", the player is deemed to have missed his second putt which comes to rest at point B9. The player is deemed to have sunk his next putt for a bogey five on the hole. In summary, B's first five shots sequentially came to rest at points B4, B7, B8 and B9 and in the cup.

THIRD PLAYER "C" (BLUE)

Third player C then places his marker at hole 35A on tee 11 initially and rolls directional die 22 (red). Assuming that the die turns up code "3-L", the player must reposition his marker in hole 35C on the tee. Further assuming that the player sequentially rolls dice 26 (white) and 28 (blue) and that each turns up code "4", it should be noted that the ball will land at point C1 and that the roll will carry the ball into ditch 34. The player is then permitted to position his marker at point C2, on the tee side of the ditch with no penalty to complete his first shot.

Assuming that player C now takes his second shot by rolling dice 24 (mauve), 26 (white) and 28 (blue) to reflect codes "2-L", "7" and "1", respectively, since there are trees ahead along the directional line occupied by C2, the player's marker must first be moved horizontally to point C3, and then a tree is encountered by his ball at point C4, leaving one hole of "energy" of flight still to be taken. Assuming that the player's roll of directional die 22 turns up code "1-L", he now moves his marker sequentially to points C5 and C6 to complete his second shot (the "energy" of the ball remains from roll of die 28 (blue) to thus permit advancement of the marker from C5 to C6).

It is assumed that for C's next shot, he rolls dice 24 (mauve), 26 (white) and 28 (blue) in sequence to reflect "3-R", "7" and "1", respectively, to move from point C6 and sequentially to points C7, C8 and C9 to complete his third shot.

For his fourth shot, golfer C may try a run-up shot (no flight—only roll) by rolling die 23 (pink) and then die 27 (gold). Assuming that the dice indicate "2-L" and "1", respectively, the player will reposition his marker to position C10 to complete his fourth shot. The player is now on green 12 four marker holes 21 from the cup and may roll green putting die ("2-R"), die 29 (silver) twice ("1" and "2") requiring that the player roll die 25 (green) again ("S") whereby the player's marker moves through points C11 and C12 and holes-out with a score of six for the hole. In summary, the player's first five shots came to rest at points C2, C6, C9, C10 and C11.

FOURTH PLAYER "D" (ORANGE)

Assuming that fourth player D rolls die 22 (red) to reflect code "4-R", he must position his marker at tee hole 35D. Further assuming that rolling of dice 26 (white) and 28 (blue) reflect codes "6" and "2", respectively, the fourth player's ball would land at point D1 in the rough and rolls only one marker hole to point D2 (energy is lost when the ball rolls through the rough in accordance with the aforementioned rules). Fourth player D is now ready to execute his second shot towards green 12 from position D2.

Assuming that the player rolls dice 23 (pink), 26 (white) and 28 (blue) to reflect codes "2-L", "8" and "2", respectively, it can be seen that there is only one manner in which this shot can be played since the flight of the ball would reach a tree at point X. The player must move two positions to the left to point D3 before counting in a forward direction towards green 12. It should be noted that another tree is encountered at point D4 with six holes of flight "energy" left. Upon rolling die 22 (red), it is assumed that code "S" turns up. The ball thereafter lands at D5, and rolls into sandtrap 20 at D6, and the roll of the ball only has a power of two (three is needed to roll out of the trap).

The player is now at point D6 in the bunker and is assumed to then roll codes "4-R" (horizontally to D7), "3" (forward to D8) and "2" (to D9), with dice 24 (mauve), 28 (blue) and 28 (blue) (a second time), respectively. The player is now at point D9 three marker holes from the cup and assuming that he rolls die 25 (green) to indicate "S" and die 28 (blue) to indicate "3", he is deemed to have made his putt to achieve a par four on the hole—a "sandy". In summary, the player's first three shots rested at points D2, D6 and D9, respectively.

What is claimed is:

1. A golf game comprising a board defining at least one golf hole thereon comprising a tee and a green spaced at a predetermined distance from said tee to simulate a fairway and the yardage therebetween, means simulating an array of hazards on said fairway, said tee including a plurality of laterally spaced tee-off positions, a coordinate system defined on said board comprising a plurality of first lines extending from said tee to said green and a plurality of second lines disposed transversely relatively to and intersecting at least most of said first lines whereby the point of intersection of each pair of said first and second lines is adapted to simulate the position of a golf ball on said board, each of said tee-off positions located at the termination of one of said first lines on said tee, whereby the position of the said hazards with respect to one of said tee off positions is different from the position of the said hazards with respect to another of said tee positions, marker means positionable on said board at one of said points of intersection of said first and second pair of lines, means controlled by a player for randomly displaying information thereon to simulate the distance and direction said marker means must be moved on said board from one of said tee-off positions on said tee to said green, a sub-coordinate system defined on said green and comprised of a plurality of spaced points with each adjacent pair of such points being spaced-apart at a distance less than an adjacent pair of points of intersection of the first and second lines of said first-mentioned coordinate system, and flag means removable and pre-positionable on any one of the points of said sub-coordinate system defined on said green whereby a player may place said marker means at a selected one of said tee-off positions taking into consideration the position of said flag means on said green.

2. The golf game of claim 1 wherein substantial portions of said first lines are parallel relative to each other and substantial portions of said second lines are parallel relative to each other and intersect said first lines in perpendicular relationship relative thereto.

3. The golf game of claim 1 wherein the points of intersection on said board and the points on the green thereof are each defined by a hole and wherein said marker means comprises a pin adapted to be inserted into a respective one of said holes.

4. The golf game of claim 2 wherein said marker means further comprises a hole formed thereon adapted to receive the pin of another marker means therein when a pair of marker means are disposed at the same point on the board.

5. The golf game of claim 4 wherein said tee comprises a plurality of holes each defined at a termination of a respective one of said first lines.

6. The golf game of claim 1 further comprising a plurality of obstacles and hazards defined on said board between said tee and said green.

7. The golf game of claim 6 wherein said hazards comprise at least one tree, at least one water hazard and at least one sandtrap.

8. The golf game of claim 1 wherein said means controlled by a player for randomly displaying information thereon comprises a first set of directional dice and a second set of distance dice.

9. The golf game of claim 8 wherein said first set of directional dice are coded on each side thereof to have some of the sides indicate straight movement of said marker means along one of said first lines and other sides thereof indicating transverse movement of said marker means along one of said second lines.

10. The golf game of claim 9 wherein said first set of directional dice comprises a first die having a plurality of first sides indicating straight movement of said marker means along said one first line, a plurality of second sides indicating movement of said marker means in a first direction along said one second line and a plurality of third sides indicating movement of said marker means in a second direction, opposite to said first direction, along said one second line.

11. The golf game of claim 10 wherein said first die has six first sides, four second sides and four third sides.

12. The golf game of claim 10 wherein said first set of directional dice further comprises second and third dice each having a plurality of first sides indicating straight movement of said marker means along said one first line and wherein a plurality of second sides of said second die indicate movement of said marker means in said first direction with two remaining sides thereof indicating movement of said marker means in said second direction and wherein a plurality of second sides of said third die indicate movement of said marker means in said second direction with two remaining sides thereof indicating movement of said marker means in said first direction.

13. The golf game of claim 12 wherein each of said second and third dice has fourteen sides.

14. The golf game of claim 9 wherein said first set of directional dice further comprises a die having faces thereon indicating direction of movement of said marker means on said green.

15. The golf game of claim 8, 9, 10 or 12 wherein each side of each die of said second set of distance dice is coded to indicate the extent of movement of said marker means along one of said first or second lines.

16. The golf game of claim 15 wherein each die of said second set of distance dice has fourteen sides.

* * * * *